US010920508B2

(12) United States Patent
Harvey

(10) Patent No.: US 10,920,508 B2
(45) Date of Patent: Feb. 16, 2021

(54) DRILLING MOTOR HAVING SENSORS FOR PERFORMANCE MONITORING

(71) Applicant: Peter R. Harvey, Houston, TX (US)

(72) Inventor: Peter R. Harvey, Houston, TX (US)

( * ) Notice: Subject to any disclaimer, the term of this patent is extended or adjusted under 35 U.S.C. 154(b) by 218 days.

(21) Appl. No.: 16/179,655

(22) Filed: Nov. 2, 2018

(65) Prior Publication Data

US 2020/0018130 A1 Jan. 16, 2020

Related U.S. Application Data

(60) Provisional application No. 62/695,870, filed on Jul. 10, 2018.

(51) Int. Cl.

| | |
|---|---|
| ***E21B 21/08*** | (2006.01) |
| ***E21B 47/06*** | (2012.01) |
| ***E21B 4/02*** | (2006.01) |
| ***E21B 7/06*** | (2006.01) |
| ***E21B 44/00*** | (2006.01) |
| ***E21B 47/12*** | (2012.01) |
| ***E21B 7/04*** | (2006.01) |
| *E21B 47/00* | (2012.01) |

(52) U.S. Cl.

CPC ..... *E21B 21/08* (2013.01); *E21B 4/02* (2013.01); *E21B 7/068* (2013.01); *E21B 44/00* (2013.01); *E21B 44/005* (2013.01); *E21B 47/06* (2013.01); *E21B 47/12* (2013.01); *E21B 7/04* (2013.01); *E21B 47/00* (2013.01)

(58) Field of Classification Search

CPC . E21B 44/00; E21B 4/02; E21B 21/08; E21B 47/00; E21B 44/005; E21B 47/12; E21B 7/068; E21B 47/06; E21B 7/04

See application file for complete search history.

(56) References Cited

U.S. PATENT DOCUMENTS

| | | | | |
|---|---|---|---|---|
| 5,679,894 | A * | 10/1997 | Kruger | E21B 47/06 73/152.03 |
| 5,842,149 | A * | 11/1998 | Harrell | E21B 44/00 702/9 |
| 6,957,698 | B2 * | 10/2005 | Krueger | E21B 21/00 166/116 |
| 8,757,255 | B2 * | 6/2014 | Toguem Nguete | E21B 43/25 166/250.15 |
| 9,206,647 | B2 * | 12/2015 | Prill | E21B 21/08 |
| 10,302,083 | B2 * | 5/2019 | Downton | F03B 13/02 |
| 2005/0150689 | A1 | 7/2005 | Jogi et al. | |

(Continued)

FOREIGN PATENT DOCUMENTS

CN 103422814 A 12/2013

OTHER PUBLICATIONS

International Search Report and Written Opinion dated Oct. 21, 2019, International Application No. PCT/US19/39745.

*Primary Examiner* — Peter J Bertheaud
(74) *Attorney, Agent, or Firm* — Richard A. Fagin

(57) ABSTRACT

An apparatus includes a sensor assembly disposable in a drill string proximate a drilling motor. The sensor assembly has a first pressure sensor in fluid communication with an upstream side of a rotor in the drilling motor, a second pressure transducer in fluid communication with a downstream side of the rotor and a rotational speed sensor coupled to the rotor. A processor is in signal communication with the first pressure transducer, the second pressure transducer and the rotational speed sensor.

14 Claims, 3 Drawing Sheets

(56) References Cited

U.S. PATENT DOCUMENTS

| | | | | |
|---|---|---|---|---|
| 2015/0053485 | A1 | 2/2015 | Altimas et al. | |
| 2015/0060141 | A1* | 3/2015 | Leuenberger | E21B 44/00 175/40 |
| 2015/0292280 | A1 | 10/2015 | Lewis et al. | |
| 2015/0346234 | A1 | 12/2015 | Campbell et al. | |
| 2016/0177703 | A1 | 6/2016 | Richards | |
| 2017/0096889 | A1 | 4/2017 | Blanckaert et al. | |
| 2018/0135402 | A1 | 5/2018 | Jeffryes et al. | |

* cited by examiner

DRILLING MOTOR HAVING SENSORS FOR PERFORMANCE MONITORING

CROSS REFERENCE TO RELATED APPLICATIONS

Priority is claimed from U.S. Provisional Application No. 62/695,870 filed on Jul. 10, 2018 and incorporated herein by reference in its entirety.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable.

BACKGROUND

The present disclosure relates to a device that houses dynamics sensors that detect and measure drilling motor power output, differential pressure, rotary speed, and temperature without affecting the performance of drilling operations within subterranean wells.

Current state of art related to this disclosure includes a memory only device providing "at bit" vibration data from accelerometers and/or gyroscopes such as one sold under the trademark BLACK BOX HD, which is a trademark of National Oilwell Varco, Houston, Tex. As packaged, such memory-only device does not have the capability to measure drill string and/or drill bit mechanical strains and thus this device cannot be used to measure drilling loads and mechanical power.

There are other dynamics sensors known in the art such as torque and weight sensors as well as rotary speed that are integral to the drill bit, yet such sensors are not modular. Their drilling load measurements are made using strain gauges configured as wheatstone bridges. Such sensors are known to require frequent recalibration and have relatively high operating costs making them impractical to apply to ordinary drilling operations.

There are dedicated near bit subs that range in length from 18 inches to 30 inches. For steerable drilling assemblies (defined as drill bits driven directly by drilling motors) these dedicated near bit subs add undesirable length that affects drilling performance and as well, must use sensors placed directly on a drilling load bearing member to make load measurements, in particular a torque measurement. For rotary steerable directional drilling systems ("RSS"), where a "closed loop" steering mechanism is placed directly behind the drill bit and in general practice is driven by a drilling motor, it is practical (i.e. does not adversely affect drilling operations) to place a short dedicated sub between the RSS and the drilling motor to measure the drilling loads and rotary speed.

Thus, a motorized RSS drilling assembly with a dedicated strain gage positioned between the drilling motor and the RSS is currently the only practical means to make the foregoing drilling dynamics measurements. Drilling weight (axial load), torque load, and bending load measurements are provided by strain gages. These measurements are known to require frequent recalibration and have relatively high operating costs making them impractical to apply to ordinary drilling operations. Pressure measurements while drilling are comparably low cost and require less frequent recalibration.

Other modular dynamics sensor packages known in the art are long and not suitable for directional drilling practices to be placed at the drill bit such as NOV's one sold under the trademark BLACK BOX LMS, which is a trademark of National Oilwell Varco, Houston, Tex. and one sold under the trademark COPILOT, which is a trademark of Baker Hughes Incorporated, Houston, Tex. These long drill collar based sensors are preferred by drillers to be above the drilling motor which makes them at least 20 ft away from the drill bit. The drilling assembly with such sensor packages does not provide direct means of measuring bit strain or rpm. Similar packages are provided by other MWD/LWD providers but have similar limitations by being above the mud motor. These above the drilling motor measurements cannot accurately determine off-bottom torque at bit nor can they determine instantaneous bit speed due to a lack of a direct measurement only possible if sensors are placed along the drive train from the drilling motor to the drill bit for either a RSS or conventional steerable drilling assembly.

SUMMARY

An apparatus according to one aspect of the present disclosure includes a sensor assembly disposable in a drill string proximate a drilling motor. The sensor assembly comprises a first pressure sensor in fluid communication with an upstream side of a rotor in the drilling motor, a second pressure transducer in fluid communication with a downstream side of the rotor and a rotational speed sensor coupled to the rotor. A processor is in signal communication with the first pressure transducer, the second pressure transducer and the rotational speed sensor.

In some embodiments, the rotational speed sensor comprises at least one of a gyroscope, an accelerometer and a magnetometer.

In some embodiments, the first pressure transducer, the second pressure transducer and the rotational speed sensor are disposed in a housing coupled to the rotor and wherein a passageway fluidly connects the downstream side of the rotor to the second pressure transducer.

In some embodiments, the fluid passage comprises a through bore in the rotor.

In some embodiments, the drilling motor comprises a progressive cavity pump or Moineau pump rotor.

A method according to another aspect of the present disclosure includes measuring pressure of drilling fluid in a drill string during wellbore drilling upstream of a rotor in a fluid powered drilling motor. Pressure of the drilling fluid downstream of the rotor is measured substantially synchronously with measuring the upstream pressure. Rotational speed of the rotor is measured substantially synchronously with the measuring upstream pressure. A power output of the drilling motor is calculated using the upstream measured pressure, the downstream measured pressure and the measured rotational speed.

In some embodiments, the measuring upstream pressure and measuring downstream pressure are performed on a same side of the rotor.

In some embodiments, the measuring downstream pressure comprises communicating the downstream pressure along a through bore in the rotor.

In some embodiments, the measuring upstream pressure comprises communicating the upstream pressure along a through bore in the rotor.

In some embodiments, the measuring rotational speed comprises measuring at least one of acceleration, magnetic field and gyroscope rotation.

Some embodiments further comprise calculating a mechanical specific energy of drilling a volume of rock formation using the calculated power output.

A drilling motor according to another aspect of the disclosure includes a motor housing connectible in a drill string. A rotor is disposed in the motor housing and operable to rotate in response to fluid pumped through the drill string. A sensor assembly is disposed in the motor housing and comprises a first pressure sensor in fluid communication with an upstream side of the rotor, a second pressure transducer in fluid communication with a downstream side of the rotor and a rotational speed sensor coupled to the rotor. The sensor assembly comprises a processor in signal communication with the first pressure transducer, the second pressure transducer and the rotational speed sensor.

In some embodiments, the rotational speed sensor comprises at least one of a gyroscope, an accelerometer and a magnetometer.

In some embodiments, the first pressure transducer, the second pressure transducer and the rotational speed sensor are disposed in a housing coupled to the rotor and wherein a passageway fluidly connects the downstream side of the rotor to the second pressure transducer.

In some embodiments, the fluid passage comprises a through bore in the rotor.

In some embodiments, the motor comprises a progressive cavity pump or Moineau pump rotor.

In some embodiments, the rotor is functionally coupled to a vibrator.

DETAILED DESCRIPTION

Figures 1A, 1B:
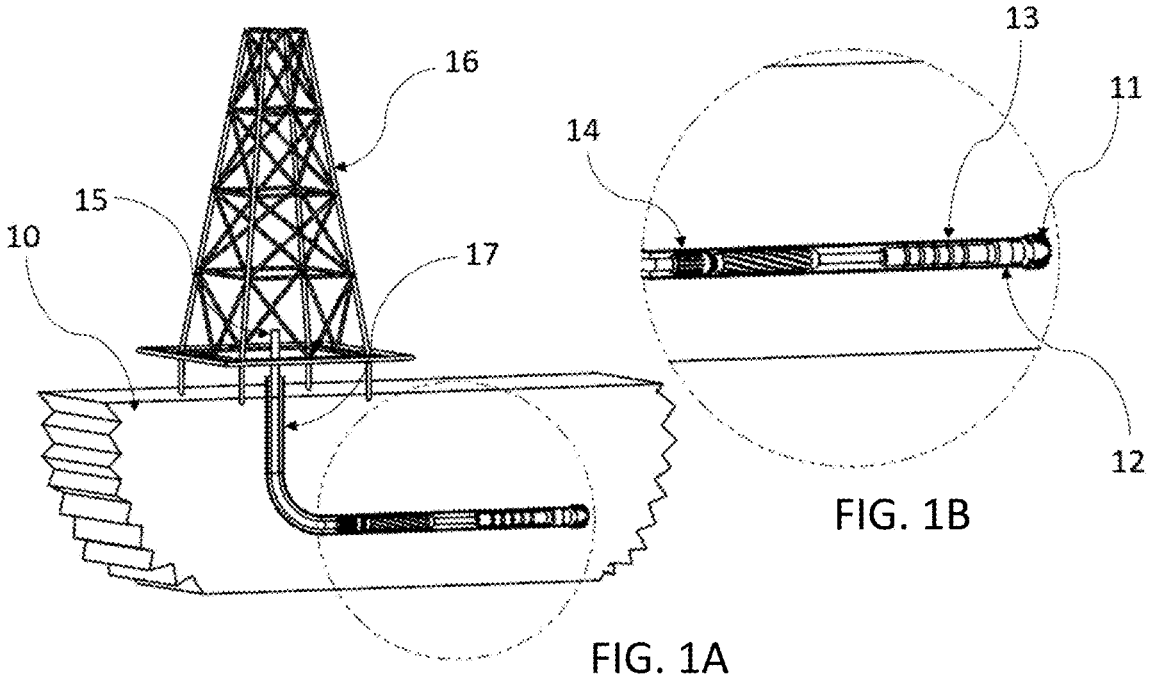
FIG. 1A shows a schematic diagram depicting a wellsite 16 with a system for determining downhole parameters including a downhole tool with a sensor assembly adjacent to a drill bit 11.
FIG. 1B shows a more detailed view of a bottom hole assembly and drill bit of the system shown in FIG. 1A.

FIG. 1A schematically shows a well being drilled by a drilling rig 16. Part of a drilling apparatus includes a system for determining certain downhole parameters. Such system includes a downhole sensor device having sensors proximate a drill bit 11. As shown, the drilling rig 16 is land based, but the drilling rig 16 could also be water based. A wellbore 17 is formed in the earth to access valuable fluids in one or more reservoirs in subsurface rock formations 10. The drilling rig 16 may include any number of associated well drilling components disposed along an assembly of drilling tools (called a drill string 15), such as a logging while drilling/measurement while drilling (LWD/MWD) tool 14, the drill bit 11, a drilling motor (mud motor 13) having a driveshaft 12 used to turn the drill bit 11. Drilling fluid ("mud") may be pumped though the drill string 15 from the drilling rig 16 and is discharged through the drill bit 11 to lubricate and cool components of the drill string 15 and to lift drill cuttings out of the wellbore 17. The flow of drilling fluid may also be used to provide power to operate the drilling motor 13. FIG. 1B shows the MWD/LWD tool 14, drill bit 11, drilling motor 13 and driveshaft 12 in more detail.

Figure 1C:
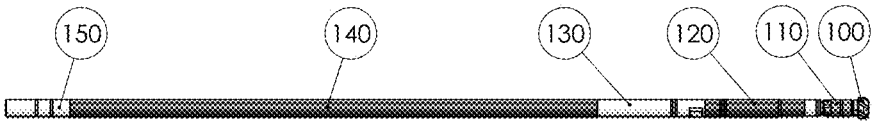
FIG. 1C shows a side view and FIG. 1D shows a sectional view of a bottom hole assembly with the downhole device with the drill bit.
Figure 1D:
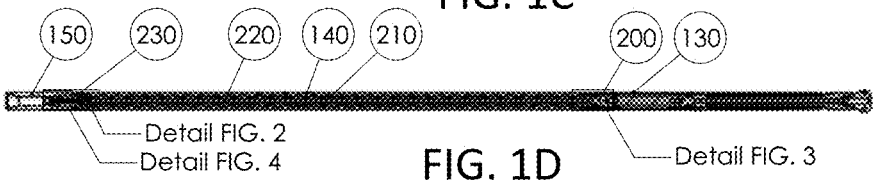

FIG. 1C shows a more detailed side view, and FIG. 1D shows a sectional side view of a bottom hole assembly (BHA) comprising a downhole sensor device 130, the drill bit 100, a drilling motor comprising a drive shaft 110, a drilling motor bearing pack assembly 120, a drilling motor transmission assembly 130, a drilling motor power section 140 (which may be a positive displacement type as shown or a turbine type), and a rotor stop drill collar 150. The BHA may include any suitable drill bit, e.g., as at 100, for drilling the wellbore (17 as shown in FIG. 1A). The BHA may have an internal flow path for allowing fluids, such as drilling mud or air, in order to lubricate drilling tool components and/or carry away drill cuttings as explained with reference to FIG. 1. The downhole sensor device 130 may be located within the internal flow path of the BHA during drilling operations.

In some embodiment, the drilling motor drive shaft 110 may be used to operate a device other than a drill bit, as will be explained further below.

Figure 2:
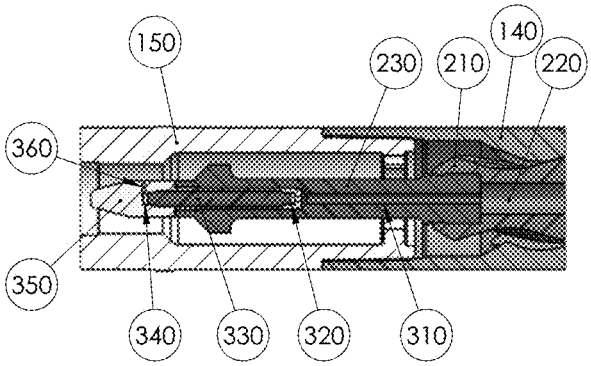
FIG. 2 shows a detailed cross-sectional view of the downhole sensor device.

FIG. 2 shows a cross-sectional view of the downhole sensor device 330 disposed within an adapter housing 350. The adapter housing 350 may be disposed within a modified rotor catch 230 having a through bore 310. The through bore 310 provides a fluid pressure communication path to a rotor through bore 220. The rotor through bore 220 may be in fluid communication with a downstream end of a rotor 210 in the drilling motor. The adapter housing 350 may be attached to the upstream end of the rotor 210. The adapter housing 350 may provide a fluid communication path 360 to enable measuring upstream fluid pressure (i.e., ahead of the rotor 210) in a first cavity 340 and may include a second cavity 320 to enable measuring drilling fluid pressure downstream of the motor (i.e., of the rotor 210) through a modified rotor catch bore 310 and the rotor through bore 220.

Figure 3:
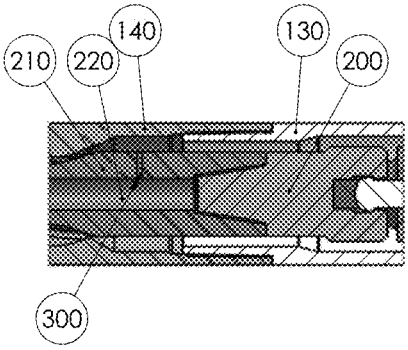
FIG. 3 shows a detailed cross-sectional view of the downstream end of rotor.

In some embodiments, and referring to FIG. 3, which shows a more detailed cross-sectional view of the downstream end of the rotor 210 and rotor thru bore 220, the downhole sensor device 330 may disposed with the upstream end, downstream end or anywhere else along the length of the rotor 210, or within a mechanical power transmission upstream housing 200. In the present embodiment a fluid pressure communication path 300 may be provided to enable measuring drilling fluid pressure downstream of the rotor (210 in FIG. 2). The downhole sensing device 330 may thus be configured to measure upstream and downstream drilling fluid pressures independently or differentially. The downhole sensing device 330 additionally may include battery power, control electronics, memory, rotary speed sensors, and temperature sensors as will be explained in more detail with reference to FIGS. 5 and 6.

A method according to the present disclosure may comprise deploying a downhole sensor device, e.g., 330 in FIG. 3, such as a battery operated device, that can measure and record drilling data related to parameters such as drilling motor power output, differential pressure, drill bit rotary speed, and temperature using an onboard processor and memory. The downhole sensor device may be disposed within a flow bore along the drilling motor power section (either turbine or positive displacement type) including end adapters to couple the sensor device to the drilling tool assembly in a manner that provides for easy disassembly to download stored data quickly, e.g., on the drilling rig floor. The measured and recorded data may be further processed along with other drilling data from drilling operations, e.g., from measurements made at the surface on the drilling rig (16 in FIG. 1), to provide information related to drilling performance, drilling optimization and completion design.

Figure 4:
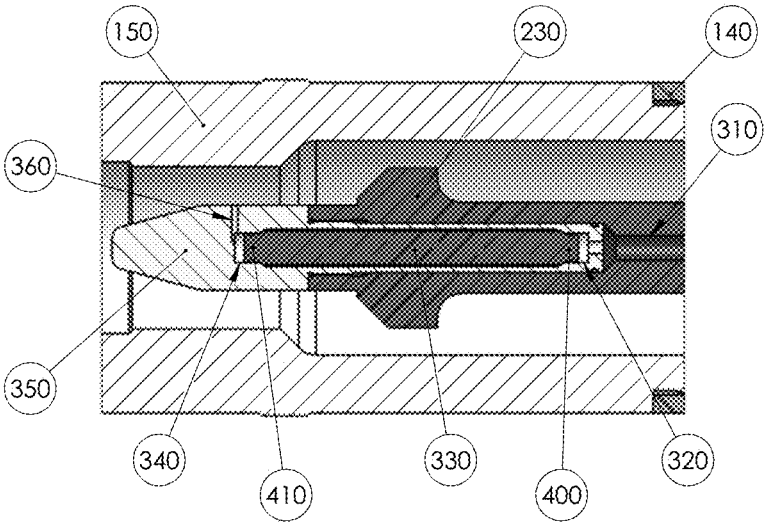
FIG. 4 further show a detailed cross-sectional view of the downhole sensor device.

The downhole sensor device 330 may be designed to be mounted in such a manner so as to communicate dynamic pressures effectively to pressure sensors (e.g., transducers) disposed in the downhole sensor device 330. FIG. 4 shows one example embodiment of mounting of the downhole sensor device 330 in a modified rotor catch 230 in the drill string (15 in FIG. 1). The downhole sensor device 330 may be configured in the BHA of any drilling tool assembly that includes a fluid flow operated drilling motor, for operating in either air or mud (liquid) drilling fluid systems. Packaging of sensors, batteries, and electronics in the downhole sensor device 330 may comprise a housing for protecting such components when exposed to drilling loads such as extreme pressure, temperature, shock, and the vibration experienced while drilling subterranean wells.

The downhole sensor device 330 according to the present disclosure is compact and may be suitable for any well plan, any drilling assembly that includes a drilling motor, and/or any drill bit type with negligible negative impact to drilling performance.

Data measured by sensors and/or calculated from the data may be recorded at high sampling rates, for example, in excess of 1000 Hz, and such measurements may be synchronized using a common on board clock and processor. Sensor measurements may be further synchronized with other drilling data to determine relationships between the measurements made by the sensors in the downhole sensor device 330 with respect to drilling activities and drill bit depths.

Figure 5:
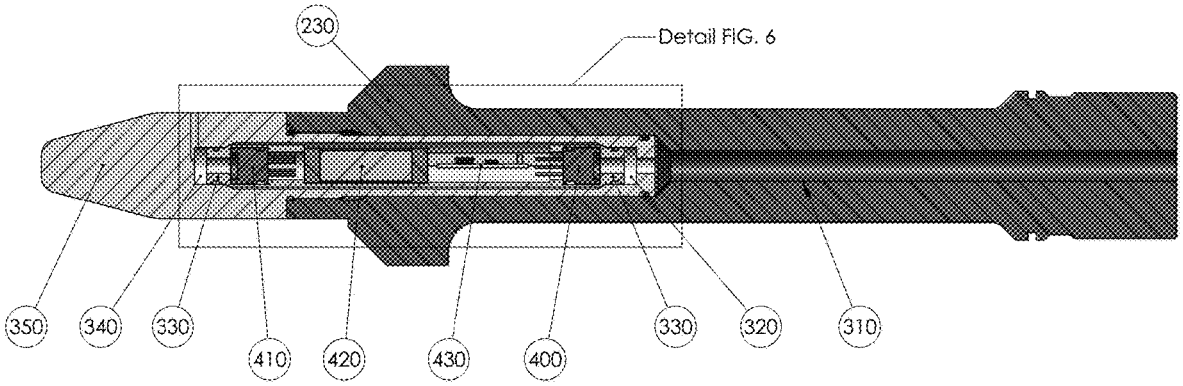
FIGS. 5 and 6 show more detailed views of a sensor device.
Figure 6:
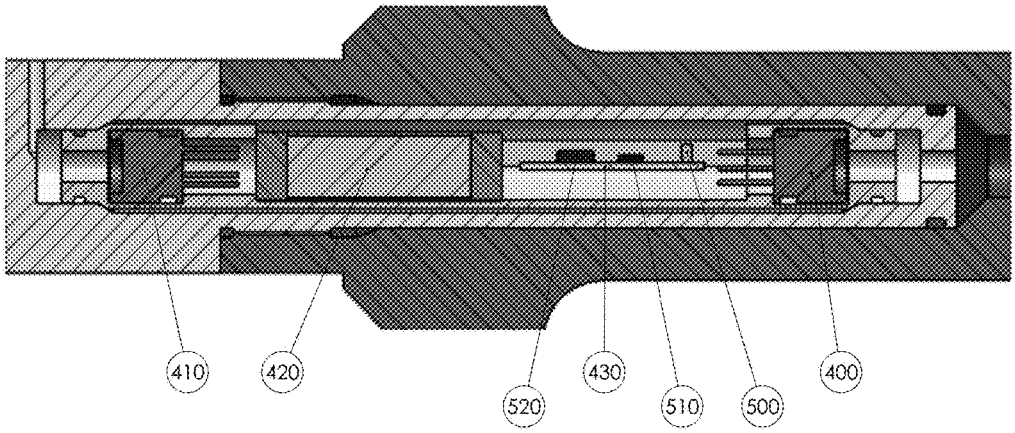

More detailed views of the downhole sensor device 330 are shown in FIGS. 5 and 6. A pressure transducer, which may be used to measure pressure downstream of the rotor (210 in FIG. 2) is shown at 400. A printed circuit board 430 may comprise measuring, recording and processing devices for the sensor measurements, as explained further below. A lithium battery pack which may be used for supplying power to electronics and sensors is shown at 420. A pressure transducer used to detect pressure upstream of the rotor (210 in FIG. 2) is shown at 410. A sensor capable of measuring rotational speed of the rotor (210 in FIG. 2), such as a MEMS gyroscope, magnetometers, or accelerometers is shown at 500. A data storage device, such as flash memory chip, for storing high resolution sensor measurements for later processing is shown at 510. A microcontroller or microprocessor that may be programmed with embedded firmware to perform functionality described herein is shown at 520.

The downhole sensor device 330 is thereby arranged to measure pressure differential or pressure drop across the rotor (210 in FIG. 1) of the drilling motor (13 in FIG. 1). Such measurements may be obtained, for example, using a first pressure transducer 410 arranged to measure the pressure of drilling fluid upstream of the rotor (210 in FIG. 2) through passageways shown at 360 and 340, and a second pressure transducer 400 to measure the pressure of drilling mud at the outlet of rotor (210 in FIG. 2) through passageways 300, 220, 310, 320. The pressure transducers 410 and 400 may comprise, for example and without limitation, piezoelectric (quartz), magnetic, capacitive, and mechanical strain gauge types. The difference between the two foregoing pressure measurements can be calculated and recorded at high sample rates. The two pressure measurements may be made effectively synchronously.

A relationship is known between pressure differential or pressure drop across the rotor 210 and the torque produced by positive displacement pump such as a Moineau pump or progressive cavity pump used as a motor. This relationship is effectively linear, wherein output torque of the motor is proportional to pressure differential across the rotor, with an offset to account for frictional losses. The following expression describes the relationship:

$$\text{Motor Output Torque}=(\text{Factor}*\text{Differential Pressure})-\text{Frictional Torque}$$

The Factor and Frictional Torque terms in the above expression may be derived based of the physical dimensions of the pump (motor) or through performance testing. Therefore, motor output torque from measurements of pressure difference across the rotor may be calculated or estimated using predetermined values of Factor and Frictional Torque. A calculated output torque may then be recorded, e.g., in the flash memory chip 510 at the same rate and at same times as the two pressure measures using transducers 400, 410.

The device 330 may also include a rotational speed sensor 500 such as a MEMS gyroscope to determine rotational speed of the rotor 210. In some embodiments, MEMS accelerometers, MEMS magnetometers or strain gages may likewise be used to determine the rotational speed of the rotor 210. Rotor speed measurements may be recorded at high sample rates and at the same times as the two pressure measurements made using the first and second transducers 400, 410.

The product of the rotor rotational speed and motor output torque may thereby be determined and recorded at the same rate and at the same times (i.e., effectively synchronously). The product represents mechanical output power of the progressive cavity pump or Moineau pump, that is:

$$\text{Mechanical Output Power}=\text{Motor Output Torque}*\text{Rotational Speed}$$

Additionally, the printed circuit board in the downhole sensor device 33 may comprise a microcontroller 520, a clock, a temperature sensor, and flash memory 510. The microcontroller 520 may be programmed with embedded firmware to perform all functionality as described herein as well as any additional features required to operate efficiently. Electrical power may be provided by a battery 420 suitable for use in MWD/LWD tools.

Calculated Mechanical Output Power may be used in combination with measurements of rate of penetration ("ROP", defined as the time rate of axial elongation of the wellbore as it is being drilled), the drill bit gauge diameter or wellbore hole size to determine the mechanical specific energy ("MSE") of drilling the wellbore.

The parameter MSE may be used to define the energy required to remove a unit volume of rock formation by drilling. More specifically, for motorized drilling assemblies a relationship defining MSE is:

$$\text{MSE}=\text{WOB}/A\text{bit}+[\text{Torque}*\text{Drill Bit Rotational Speed}]/[A\text{bit}*\text{ROP}]$$

wherein WOB is the axial force (weight) applied to the drill bit, Abit represents the cross-sections area of the drill bit. Presently known fixed cutter drill bits or hybrid drill bits make the effect of the WOB term in the above expression negligible, allowing the relationship to be expressed as:

MSE=[Torque*Drill Bit Rotational Speed]/[Abit*ROP]

As stated above, Abit represents the cross-sectional area of well bore hole size or drill bit diameter, that is:

Abit=[π*Drill Bit Diameter^2]/4

The relationship between MSE and certain properties of the rock formations provides a basis for using MSE in drilling optimization and well completion engineering. The approach defined herein may provide both a cost effective and a more accurate, higher resolution measurement that what is known prior to the present disclosure.

In some embodiments, the drive shaft (110 in FIG. 1C) may drive a different device than a drill bit. In such embodiments, other tools deployed for oil and gas wellbore intervention, fishing and casing running operations may be operated by a drilling motor as explained herein. In particular, in drilling operations, one or more drill string vibrators may be deployed anywhere along the drill string to reduce friction and drilling dysfunction, leading to improved drilling performance and efficiency. The drive shaft of such drilling motor(s) may be used to rotate such vibrator. Vibrators that may be operated using a motor as disclosed herein comprise, one sold under the trademark AGITATOR, which is a trademark of National Oilwell Varco, Houston, Tex. and one sold under the trademark VIBE SCOUT, which is a trademark of Scout Downhole, Inc., Conroe, Tex.

In these additional applications or any others that deploy the use of progressive cavity pumps or turbines to convert hydraulic power to another form of power, the device disclosed herein may provide valuable performance measurements to the user. These performance measurements may in turn assist in optimizing drilling and casing operation workflows.

Although only a few examples have been described in detail above, those skilled in the art will readily appreciate that many modifications are possible in the examples. Accordingly, all such modifications are intended to be included within the scope of this disclosure as defined in the following claims.

What is claimed is:

1. An apparatus, comprising:

a sensor assembly disposable in a drill string proximate a drilling motor, the sensor assembly comprising a first pressure transducer in fluid communication with an upstream side of a rotor in the drilling motor, a second pressure transducer in fluid communication with a downstream side of the rotor and a rotational speed sensor coupled to the rotor, the first pressure transducer, the second pressure transducer and the rotational speed sensor disposed in a housing coupled to the rotor and wherein a through bore in the rotor fluidly connects the downstream side of the rotor to the second pressure transducer; and a processor in signal communication with the first pressure transducer, the second pressure transducer and the rotational speed sensor.

2. The apparatus of claim 1 wherein the rotational speed sensor comprises at least one of a gyroscope, an accelerometer and a magnetometer.

3. The apparatus of claim 1 wherein the drilling motor comprises a progressive cavity pump or Moineau pump rotor.

4. A method, comprising:

measuring pressure of drilling fluid in a drill string during wellbore drilling upstream of a rotor in a fluid powered drilling motor;

measuring pressure of the drilling fluid downstream of the rotor substantially synchronously with measuring the upstream pressure, wherein the measuring upstream pressure and downstream pressure are performed on a same side of the rotor and measuring downstream pressure comprises communicating pressure along a through bore in the rotor;

measuring rotational speed of the rotor substantially synchronously with the measuring upstream pressure; and calculating a power output of the drilling motor using the upstream measured pressure, the downstream measured pressure and the measured rotational speed.

5. The method of claim 4 wherein the measuring rotational speed comprises measuring at least one of acceleration, magnetic field and gyroscope rotation.

6. The method of claim 4 further comprising calculating a mechanical specific energy of drilling a volume of rock formation using the calculated power output.

7. A drilling motor, comprising:

a motor housing connectible in a drill string;

a rotor disposed in the motor housing and operable to rotate in response to fluid pumped through the drill string; and a sensor assembly disposed in the motor housing and comprising a first pressure transducer in fluid communication with an upstream side of the rotor, a second pressure transducer in fluid communication with a downstream side of the rotor and a rotational speed sensor coupled to the rotor, the first pressure transducer, the second pressure transducer and the rotational speed sensor disposed in a housing coupled to the rotor and wherein a through bore in the rotor fluidly connects the downstream side of the rotor to the second pressure transducer, the sensor assembly comprising a processor in signal communication with the first pressure transducer, the second pressure transducer and the rotational speed sensor.

8. The drilling motor of claim 7 wherein the rotational speed sensor comprises at least one of a gyroscope, an accelerometer and a magnetometer.

9. The drilling motor of claim 1 wherein the motor comprises a progressive cavity pump or Moineau pump rotor.

10. The drilling motor of claim 7 wherein the rotor is functionally coupled to a vibrator.

11. A method, comprising:

measuring pressure of drilling fluid in a drill string during wellbore drilling upstream of a rotor in a fluid powered drilling motor;

measuring pressure of the drilling fluid downstream of the rotor substantially synchronously with measuring the upstream pressure;

measuring rotational speed of the rotor substantially synchronously with the measuring upstream pressure;

calculating a power output of the drilling motor using the upstream measured pressure, the downstream measured pressure and the measured rotational speed; and calculating a mechanical specific energy of drilling a volume of rock formation using the calculated power output.

12. The method of claim 11 wherein the measuring upstream pressure and measuring downstream pressure are performed on a same side of the rotor.

13. The method of claim 12 wherein the measuring downstream pressure comprises communicating the downstream pressure along a through bore in the rotor.

14. The method of claim 11 wherein the measuring rotational speed comprises measuring at least one of acceleration, magnetic field and gyroscope rotation.

* * * * *